US005596932A

United States Patent [19]

Honegger

[11] Patent Number: 5,596,932

[45] Date of Patent: Jan. 28, 1997

[54] PROCESS AND APPARATUS FOR THE TYPOGRAPHICAL LABELING OF FOLDED PRINTED PRODUCTS ON AN INNER SIDE

[75] Inventor: Werner Honegger, Bäch, Switzerland

[73] Assignee: Ferag AG, Hinwil, Switzerland

[21] Appl. No.: 548,447

[22] Filed: Oct. 26, 1995

[30] Foreign Application Priority Data

Oct. 28, 1994 [CH] Switzerland ..... 03230/94

[51] Int. Cl.[6] ..... B41F 27/00

[52] U.S. Cl. ..... 101/485; 101/232; 101/408; 270/1.01; 270/1.02; 271/204; 271/277

[58] Field of Search ..... 101/483, 485, 101/486, 232, 408; 270/1.01, 4, 1.02, 1.03, 52, 14; 271/204, 277

[56] References Cited

U.S. PATENT DOCUMENTS

| | | | |
|---|---|---|---|
| 4,170,346 | 10/1979 | Murray | 270/1.02 |
| 4,538,161 | 8/1985 | Reist | 346/140 R |
| 4,892,944 | 1/1991 | Eberle | 101/408 |
| 4,989,850 | 2/1991 | Weller | 270/1.02 |
| 5,188,349 | 2/1993 | Honegger | 271/277 |
| 5,292,111 | 3/1994 | Hansch | 271/204 |
| 5,354,043 | 10/1994 | Reist | 270/54 |

FOREIGN PATENT DOCUMENTS

| | | |
|---|---|---|
| 2110614 | 6/1994 | Canada . |
| 096228 | 12/1983 | European Pat. Off. . |
| 564812 | 10/1993 | European Pat. Off. . |
| 600216 | 6/1994 | European Pat. Off. . |
| WO/93/07081 | 4/1993 | WIPO . |

OTHER PUBLICATIONS

LOGIC; "The integrated Inkjet system: Real time personalization and addressing."; FERAG.

*Primary Examiner*—Eugene H. Eickholt
*Attorney, Agent, or Firm*—Bell, Seltzer, Park & Gibson, P.A.

[57] ABSTRACT

A process and an apparatus for the typographical labeling of folded printed products, such as folded individual sheets or folded publications, on an inner side, in particular in the border region of the inner side, is designed for carrying out this typographical printing in folded printed products which are conveyed with their fold approximately at right angles with respect to the conveying direction, and can thus be used with the conveying systems which are conventional nowadays in printing works for conveying printed products in the form of imbricated streams. The front and rear halves of the respective folded printed products are moved apart via an opening device, with the result that a printing head can carry out the desired typographical-labeling operation on the inner side of the folded printed product. Since the typographical labeling takes place when the folded printed products are in a curved state, the inherent elasticity of the printed products serves to press that region which is to be printed against a corresponding guide, as a result of which the products can be transported past the printing head without fluttering and a clean printed image is achieved.

16 Claims, 3 Drawing Sheets

PROCESS AND APPARATUS FOR THE TYPOGRAPHICAL LABELING OF FOLDED PRINTED PRODUCTS ON AN INNER SIDE

FIELD OF THE INVENTION

The present invention relates to a process and apparatus for the typographical labeling of folded printed products, such as folded individual sheets or folded publications, on at least an inner side in a border region thereof. During this process, the respective folded printed products are conveyed by a conveying device and are at least partially opened and guided past a printing head. In a preferred embodiment, the printing head is an inkjet printer wherein the typographical printing of at least one half of the respective printed product is carried out in an at least an essentially planar region.

BACKGROUND OF THE INVENTION

A prior art process is set forth in the International Patent Application having the publication number WO 93/07081. That process describes typographical labeling or a caption on the inner sides of books borne by a conveying device. In the conveying device, the books are borne in the folded state, the fold being located parallel to the conveying direction, and the two halves of the respective printed products being arranged to the left and right of the conveying device and hanging downwards therefrom. A guide cord is located beneath the conveying device and serves for retaining the two halves of the printed products at a slight distance apart from one another. Adjoining one end of the cord is a plough-like part, which turns one half of the folded printed product increasingly into a horizontal position from the vertical position, the typographical labeling being carried out in the border region of the page of the horizontally guided half of the books by a printing head which is fitted in the region of the delivery end of the plough.

This known process and apparatus maintains as constant as possible, the acceleration of the half of the printed products which are moved from the vertical position into the horizontal position, since a higher operating speed is thereby expected.

It may be problematical, in the case of this arrangement, that, despite the constant acceleration, conveying the printed products with the fold parallel to the conveying device leads to the air which is displaced and, as a result, being forced between the pages of the printed products and causing them to flutter, especially when a higher circulating speed of the conveying device is desired.

The prior art also includes the integrated inkjet system of the company Ferag AG, Hinwil/Switzerland, which permits typographical labeling of border regions of individual pages of a printed product, but has not yet been designed to permit opening of folded printed products for typographical-labeling purposes.

SUMMARY OF THE INVENTION

An object of the present invention is to provide a precise process and apparatus for the typographical labeling of the inner side of a printed product permitting typographical labeling at high conveying speeds reliably and with a relatively low degree of outlay. The page which is to be labelled typographically being guided in the region of the printing head, there being no risk of the pages of the printed products fluttering.

To achieve this object, it is provided according to the process of the present invention, that the respective folded printed products are transported with their fold transverse with respect to the conveying device, and that an opening device ensures that the products are opened in the conveying direction or counter thereto, the grippers of the conveying device still retaining the two halves of the respective printed products in the fold region and pressing them against one another there.

By virtue of the fact that the printed products are conveyed with their folds approximately at right angles with respect to the conveying device, the risk of the pages of the products fluttering is practically avoided and even with use of high transporting speeds. Furthermore, the fluttering of the pages of the printed products is further suppressed by the grippers, which hold the two halves of the respective printed products together in the fold region.

It is particularly favorable if the folded printed products are opened such that an arc or loop is formed in at least that half of the respective folded printed products which is to be labelled typographically, while the border region of said half is guided over an at least essentially planar guide.

By virtue of the curved configuration of the halves of the printed products as a result of the arc or loop formation, the inherent elasticity of the printed products ensures that the border region of the half is pressed onto the guide, as a result of which any fluttering can be eliminated and, in addition, precise positioning, with respect to the printing head, of the region which is to be labelled typographically can be achieved.

The process may also be carried out such that, in the region of the printing head, after the partial opening of the printed products, the two halves of the respective printing products are moved towards one another beneath the grippers of the conveying device, but above the border region which is to be labelled typographically, in order to increase the curvature of the arc or of the loop. This can achieve an increase in the contact pressure between the guide and border region of the printed product, with the result that optimum positioning and guiding of the printed products in the region of the printing head is obtained. It is particularly favorable that the parts which move the two halves of the respective printing products towards one another, despite a high operating speed, do not need to drag along the outer sides of the folded printed products to a pronounced extent, with the result that there is no risk of such parts impairing the printed image which has already been produced.

BRIEF DESCRIPTION OF THE DRAWINGS

The invention is explained in more detail hereinbelow with reference to exemplary embodiments which are shown schematically in the accompanying drawing, in which.

DETAILED DESCRIPTION OF THE DRAWINGS

Figure 1:
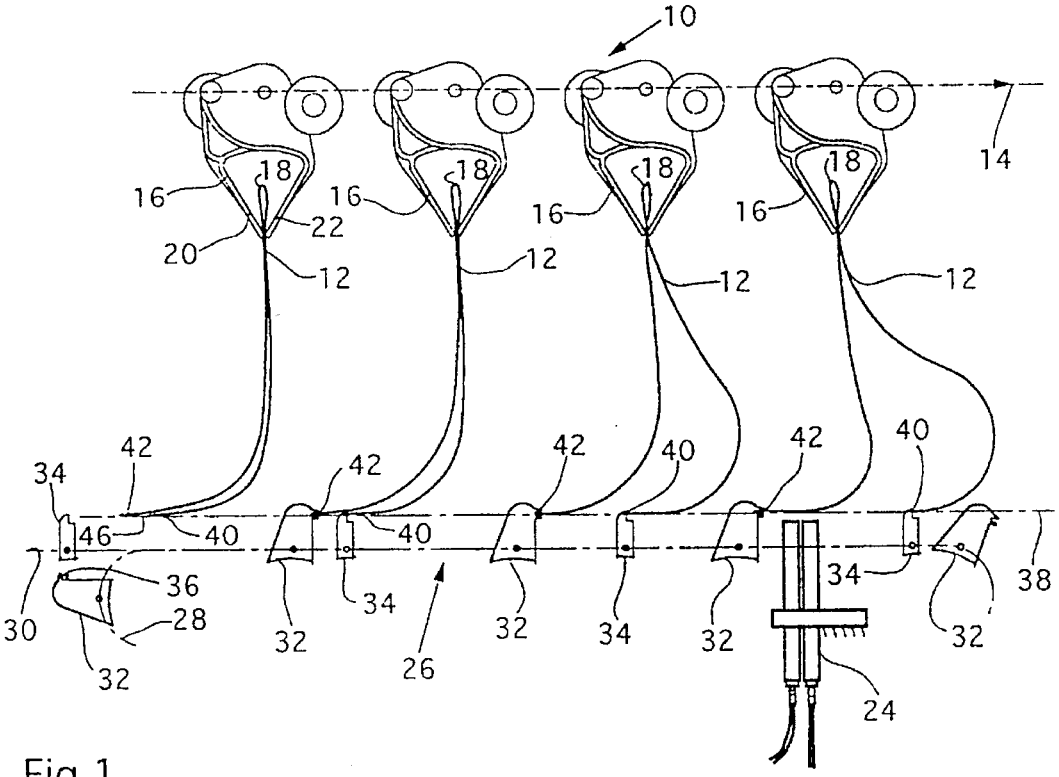
FIG. 1 shows a schematic side view of a conveying device, according to the invention, with an opening device in the region of the printing head.

In the case of the embodiment according to FIG. 1, a conveying device 10 for conveying folded printed products 12 in the form of a fanned-out imbricated formation is shown. The conveying direction is specified by 14, i.e. the individual grippers 16 of the conveying device, which grippers bear the respective folded printed products 12 are spaced apart at regular intervals from one another and are moved in the conveying direction 14.

The grippers 16 each retain a folded printed product 12 in the region directly beneath the respective fold 18. Such grippers are well known in practice, and the gripping fingers 20 and 22 of the individual grippers can be opened and closed in order to receive or discharge a folded printed product. The grippers are all shown in the closed state in FIG. 1.

The printed products 12 may be individual folded sheets which are subsequently put together with other sheets to form a complete publication, for example a periodical or a part thereof. However, the printed products 12 may also be a number of folded-together sheets which are subsequently brought together with further folded-together sheets to form a complete product, for example a periodical or a book, or the printed products 12 may be already finished periodicals, publications or similar products. In each case, and this also applies to all the further exemplary embodiments, it is desired to carry out typographical labeling, in a border region of the inner side of the printed product, by means of a printing head 24, it being possible for the typographical labeling to be carried out, for example, entirely according to individual requirements. For example, the name of a customer receiving the printed product may be printed in the border region of the inner side. The border region may be a lateral border region of the printed product, i.e. the border region which is located parallel to the fold 18, but remote therefrom, or the border region may be the upper or lower border of the relevant page.

The apparatus may be used for catalogues in the interior of which an order form is secured in the center, the address of the customer, i.e. of the recipient of said catalogue, already being printed on the inner side thereof. If, for example, the customer wishes to obtain the article on offer, or a plurality of said articles, then all that he or she need do is to provide the order form with the order information, but not with his or her address.

During the production of the order form, the folded order form thus has to be opened before collation and printed with the desired address.

Since the catalogue comprises a plurality of folded parts, it is possible to provide such an order form for each inner side of a folded part. Although the typographical-labeling apparatus of FIG. 1 (and likewise the other typographical-labeling apparatuses described below) are conceived predominantly for carrying out typographical labeling on the central inner side of the respective folded printed product, nevertheless, upon putting together a plurality of folded printed products which each exhibit typographical labeling on the central inner side, typographical labeling which is not just on the central inner side of the finished product can be achieved.

In the case of the preferred apparatus, the folded printed products, which are conveyed in the folded state, have to be opened to such an extent that the border region which is to be labelled typographically becomes exposed. For a clean typeface, said border region has to lie in an at least essentially planar manner during the typographical labeling. The printed products are opened, in the case of the embodiment according to FIG. 1, by using an opening device 26 which is designed as is disclosed in the European Patent Application of the same applicant having the publication number EP-A-0 564 812, incorporated herein by reference, the opening device therein being used for another purpose.

Said opening device 26 according to EP-A-0564812 essentially comprises two circulating conveying chains or strands 28, 30 which are arranged one beside the other and bear respective grippers 32 and 34. Here, the arrangement is such that the respectively upper strands of the two conveying devices 28, 30 are located one beside the other and likewise move in arrow direction 14, the conveying device 30, however, running somewhat more quickly than the conveying device 28, and the latter moving essentially at the speed of the conveying device 10. This results in the grippers 34 increasingly moving apart from the grippers 32 in the course of the movement parallel to the conveying device 10. In this arrangement, the grippers 34, which each exhibit a clamping tongue (not shown), are designed such that they clamp the lower end 40, remote from the fold 18, of the front half of the folded printed product, while the subsequently used gripper 32 for the same folded printed product 12 receives the end 42, remote from the fold 18, of the rear half of the folded printed product. For this purpose, the grippers 32 are also provided with a clamping tongue 36.

When the folded printed products enter the region of the opening device 26, said products are already guided on a guide surface 38, with the result that they exhibit the curved form of the printed product 12 represented on the left-hand side, and the end 40, remote from the fold 18, of the front half of the folded printed product 12 is at a small but defined spacing 46, as seen in the conveying direction 14, from the end 42, remote from the fold 18, of the rear half of the folded printed product 12. The gripper 34 can thus reliably be brought into contact with the lower end 40 of the front half of the folded printed product 12, for example when, moving upwards from the bottom around a deflection roller (not shown), it comes to bear in the region of the spacing 46, i.e. similar to the case in the representation on the left-hand side of FIG. 1 for the gripper 32.

For further details of the design of the opening device 26, reference may be made to the above mentioned EP-A-0 564 812.

The printing head 24 is arranged in the region of the outlet-side deflection roller in the opening device 26 and is designed for the typographical labeling of the rear half of the folded, but open product in the border region.

The printing head 24 is, in a preferred embodiment, designed as an inkier printer, as is described in the European Patent Application of the present applicant having the publication number EP-A-0096228, incorporated herein by reference. For further details, reference may be made to this earlier application. All the advantages which apply to the inkjet printer 18 according to EP-A-0096882 also apply here, for example, the fact that the signal which triggers the printing operation can be produced by remote control corresponding to the cycle of the conveying device. Here too, a monitor (not shown) may be provided in order to suppress the typographical-labeling operation in the case of unoccupied grippers and to prevent the installation being soiled with ink. These statements regarding the printing head also apply to all the further embodiments of the invention which are described hereinbelow. It is noted though, that printing heads other than inkjet printers may be utilized.

In the case of the configuration of FIG. 1, it can be said that the folded products are trailing, because the folded products are bent rearwards.

Figure 2:
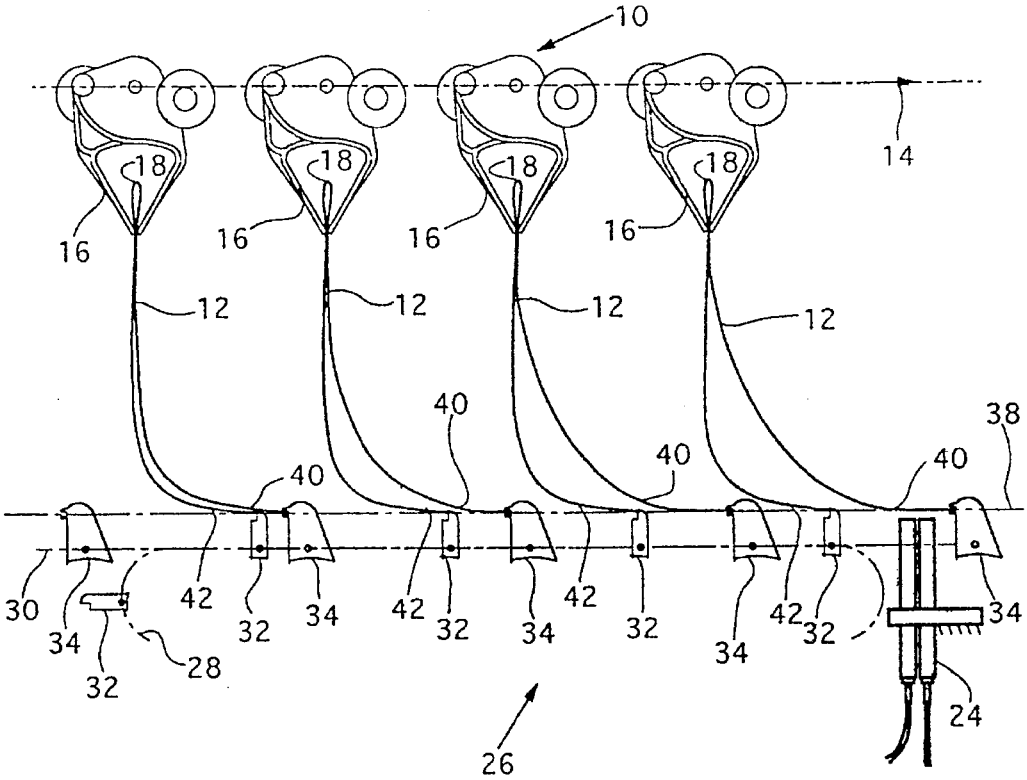
FIG. 2 shows a further embodiment, according to the invention, similar to FIG. 1, but in a modified configuration.

The alternative embodiment according to FIG. 2 is similar to the embodiment of FIG. 1 and, as for all the further exemplary embodiments, the same reference numerals are used for the same parts, so that a detailed description of the individual parts in conjunction with the further embodiments can be dispensed with.

In FIG. 2, unlike the embodiment of FIG. 1, the individual folded printed products 12 are guided such that the lower ends of the two halves of the respective printed products precede the respective gripper 16 of the conveying device 10. In this example, the typographical labeling is carried out by means of the printing head 24 in the border region of the leading half of the folded printed product 12. This means, that in this example too, the grippers 32 with the conveying arrangement 28 move at approximately the same speed as the conveying device 10, while the grippers 34 on the conveying device 30 run more quickly. This embodiment of the opening device 26 corresponds, in detail, to the embodiment of FIG. 30 of the above-mentioned European Patent Application EP-A-0564812 of the present applicant.

Figure 3:
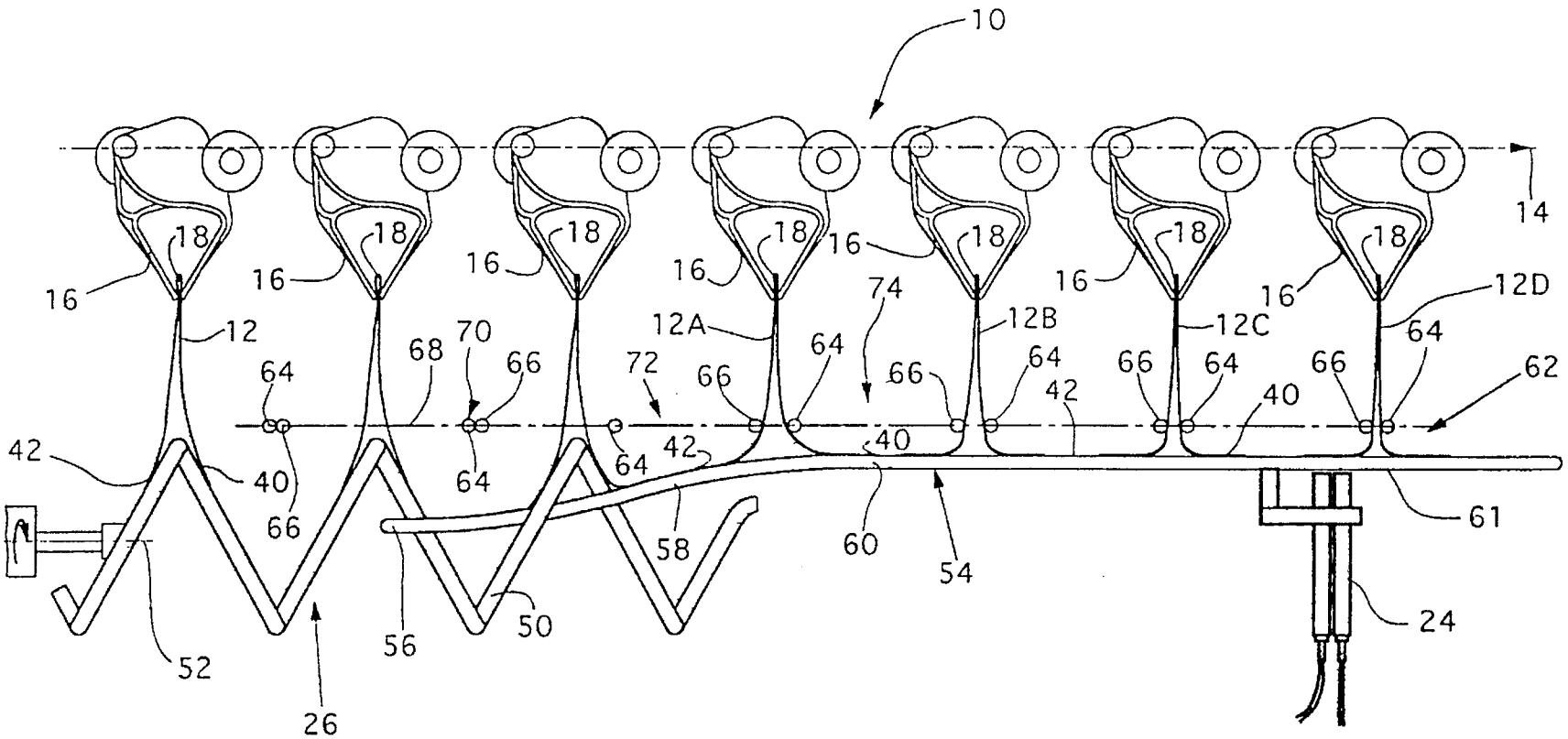
FIG. 3 shows a schematic side view of a further apparatus according to the invention for the typographical labeling of the inner sides of folded printed products.

FIG. 3 then shows a further embodiment of the apparatus according to the invention, in the case of which the opening device 26 is of a different design. To be specific, the opening device here is designed approximately correspondingly to the opening device of the European patent application of the present applicant having the publication number EP-A-0600216, incorporating herein by reference. Accordingly, the opening device comprises a helically wound bar 50 whose central longitudinal axis 52, which simultaneously constitutes the rotational axis of the opening device, is arranged at least essentially parallel to the conveying direction 14. It can be seen that the pitch between the individual windings of the helical bar 50 is essentially identical to the distance between the adjacent grippers 16 of the conveying device 10. The helical opening device 26 is driven at a rotational speed which results in the respectively upper parts of the individual windings moving at the same speed in the axial direction 52 as the grippers of the conveying device 10 move in the conveying direction 14. The windings of the helical bar 50 thus retain the folded printed products 12 in a slightly open state.

Arranged in front of the helical bar 50 is a guide 54 which belongs to the opening device. Said guide 54 has a rear section 56, in relation to the conveying direction 14, which extends within the helical bar 50. The rear section 56 of the guide 54 merges, via a central section 58 of the guide 54, which central section 58 comes increasingly closer to the conveying device 10, into the front section 60 of the guide 54, which front section 60 runs parallel to the conveying device 10 and is arranged at a distance beneath the conveying device, said distance being smaller than the width of the front and rear halves of the folded printed products 12.

Due to this shaping of the guide 54, the halves, which are retained in the slightly open state, of the respective printed products 12 are opened further, with the effect that the ends 40, 42, remote from the fold 18, of the front and rear halves move increasingly away from one another and rest flatly against the guide 54. The printing head 24 is then arranged beneath the guide, in the front region 61 of the same. The apparatus, as has been described hitherto, can also function in this form without any further constituent parts. However, a clamping device 62 is preferably provided in addition, which clamping device 62 is likewise configured as a circulating device which runs parallel to the conveying direction 14 of the conveying device, in the region of the printing head 24. The clamping device 62, here, comprises a conveying device which bears pairs of clamping fingers 64, 66 which can be moved away from one another and towards one another in the region of the guide 54.

Located in the region of the rear section 56 of the guide 54 is the clamping-finger pair 70 whose clamping fingers 64 and 66 are arranged closely one beside the other. The clamping-finger pair 72, which is located in front of the clamping-finger pair 70, has, however, already passed into a state in which the clamping fingers 64 and 66 have moved apart from one another.

In the case of the clamping-finger pair 74, this movement is already virtually complete, with the result that the clamping finger 64 of the clamping-finger pair 74 interacts with the clamping finger 66 of the clamping-finger pair 72 and pushes the two halves of the printed product 12A together to some extent.

In the case of the printed product 12B located in front of this, the distance between the respective clamping fingers 66 and 64 has become smaller, and this distance is increasingly reduced as far as the folded printed product 12D which is furthest to the front in FIG. 3. By virtue of this clamping movement of the invention, the printed product is forced to undergo a more pronounced curvature in the region of the guide 54, as a result of which the inherent elasticity of the printed products ensures that the border regions of the front and rear halves rest flatly against the guide 54, so that there is no risk of fluttering of said regions or of undesired movement relative to the printing head 24.

Figure 4:
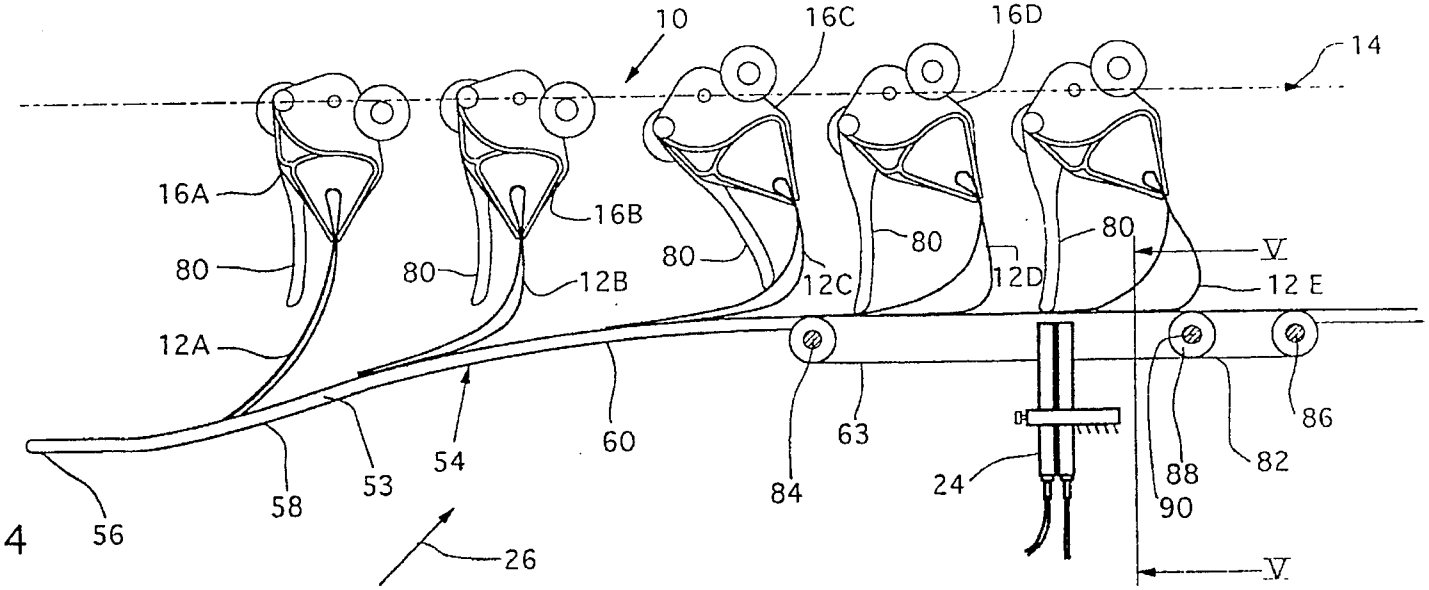
FIG. 4 shows a fourth variant of an embodiment, according to the invention, of an apparatus for the typographical labeling of folded printed products
Figure 5:
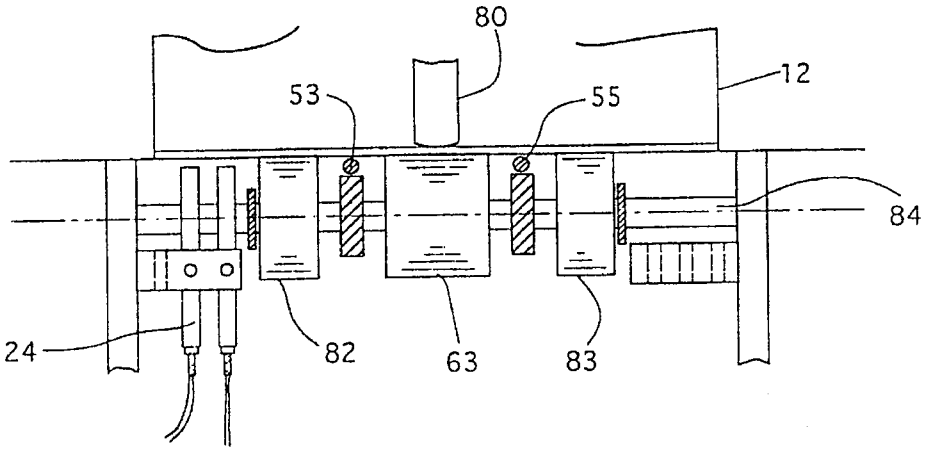
FIG. 5 shows a sectional view in arrow direction V—V of the apparatus of FIG. 4.

FIGS. 4 and 5 show a fourth embodiment of an apparatus according to the invention, which, similarly to FIG. 3, operates with a guide 54, which, here however, comprises a static part and a moving part and is designated as a guide unit.

It can be seen from FIG. 4 that the rear end 56 of the guide unit 54 is spaced apart from the grippers 16 of the conveying device 10 by a distance which corresponds essentially to the width of the folded printed products which are transported by the grippers 16.

As can be seen from FIG. 5, the guide unit 54 comprises two statically arranged guide bars 53, 55 which, in side view, are each in the form of the guide 54 of the configuration according to FIG. 3, and the guide unit 54 further comprises, at the front section 60 of the guide bars, a conveying belt 63 which circulates at the same speed as the conveying device 10.

In the central region 58 of the guide unit 54, where the latter comes closer to the conveying device 10, the folded printed products are forced to assume an increasingly curved form, with the result that, for example, the curved form of the individual printed products 12 changes from the slightly curved form 12A into the more steeply curved form 12B and then into an even more steeply curved form 12C.

In addition to the guide unit 54, the opening device 26 comprises for each gripper, one or more pressure-exerting fingers 80 which extend essentially vertically downwards in the reap and central sections 56 and 58 of the guide unit 54 and are shorter than the respective distance between the respective gripper 16 and the guide unit 54.

The central gripper 16C of the conveying device 10 is pivoted, at the beginning of the front section 60 of the guide path 60, in the anti-clockwise direction into an inclined position, as a result of which the pressure-exerting finger 80 comes into contact with the rear half of the respective printed product 12C and increases the curvature of said printed product.

As the gripper 16C is moved further into the position of the gripper 16C, the pressure-exerting finger 80 is pivoted rearwards via a pivoting mechanism (not shown) and passes into the depicted position, in which the rear half of the printed product 12D is pressed against the conveying belt 63 which runs along with the conveying device 10.

Located to the left and right of the front part 60 of the guide bars 54 are two circulating belts 82, 83 of a belt conveyor (as is represented in FIG. 5), which belts, however, run more quickly in the same direction 14 than the conveying device 10 and the centrally arranged circulating conveying belt 63. This arrangement results in the front halves of the respective printed products being distanced from the rear halves in the conveying direction 14, with the result that the printing head 24 can carry out the desired typographical labeling in the inner border region of the rear half of the respective printed product 12E.

After the typographical labeling of the respective printed products, the grippers 16 can be pivoted back into the position which is shown for the grippers 16A and 16B. The pivoting of the grippers and of the pressure-exerting fingers 8 can be controlled by respective guide paths, which, for the sake of simplicity, are not shown.

As can be seen from FIG. 5, in conjunction with FIG. 4, the rear deflection spindle 84 for the rear deflection rollers of all three belts 63, 82, 83 is a common spindle and is mounted in a freely rotatable manner. A common spindle 86, which is configured as a driven spindle, is, in turn, provided for the front deflection rollers of the two conveying belts 82, 83. A separate drive spindle 90 is provided for the front deflection roller 88 of the circulating guide belt 63. By virtue of this arrangement, the drive spindle 90 can be driven at the required different speeds with respect to the drive spindle 86, in order to produce the different linear surface speeds of the respective conveying belts 63 and 82, 83. The position of the printing head 24 can be freely selected depending on the position of the region which is to be labelled typographically, the conveying belts 63, 82, 83 having to be arranged in a correspondingly different manner.

Instead of, as is shown in FIGS. 1–4, routing the conveying device 10 in a rectilinear manner in the region of the printing head 24, a curved movement path of the grippers 16 is also possible. The progression of the opening device 26 has to be adapted correspondingly in this case (curved progression instead of rectilinear progression).

That which is claimed is:

1. A process for the typographical labeling of folded printed products on at least an inner side in a border region thereof comprising the steps of retaining folded printed products defined substantially by two halves by a conveying device, at least partially opening and guiding the printed products past a printing head wherein the typographical labeling is applied to the inner side of at least one half of a printed product in an at least essentially planar region thereof, transporting the folded printed products with their fold transverse with respect to a conveying direction to expose a region which is to be labelled typographically, moving apart the printed product halves in the conveying direction by providing an opening device, and retaining the two halves of the printed products at the fold thereof and pressing them against one another with grippers of the conveying device.

2. A process according to claim 1, wherein the step of moving apart the halves of the folded printed products includes the use of a formation of an arc or loop in at least that half of the folded printed products which is to be labelled typographically, while a border region of said half which is to be labelled typographically is guided over a planar guide.

3. A process according to claim 2, wherein, in a region of the printing head after the halves have been moved apart, the two halves of the printed products are moved towards one another beneath the grippers of the conveying device to increase the curvature of the arc or of the loop.

4. A process according to claim 1, wherein the opening device comprises at least one first and one second part, wherein said parts act on respective ends of the two halves of the printed products remote from the fold and displaces said ends relative to one another and parallel to the conveying direction.

5. A process according to claim 2, wherein, in a region of the printing head, a pressing force is exerted on one half of the respective folded printed products which are to be labelled typographically, as a result of which said half is pressed on to the guide during the conveying movement, the guide being designed to run along with the conveying device.

6. A process according to claim 5, wherein by means of a further belt conveyor which is arranged next to the guide which runs along with the conveying device, and runs more quickly than said guide, the other half of the folded printed product is moved away from the half which is pressed on to said guide.

7. An apparatus for the typographical labeling of at least one half of folded printed products each having two halves on at least an inner side of a border region each thereof comprising a conveying device which transports the folded printed products, an opening device which at least partially separates the halves of the folded products from one another, a printing head arranged in a region of the conveying device, said conveying device comprising grippers which retain the folded printed products one behind the other in the form of a fanned-out imbricated formation, wherein said opening device is designed to expose the region which is to be labelled typographically by virtue of different movements of the two halves of the printed products parallel to the conveying direction wherein the grippers of the conveying device retain printed products at a region near the fold and press the two halves of said printed product against one another.

8. An apparatus according to claim 7, further comprising a guide arranged beneath the conveying device in a region of the printing head which is substantially planar at least in said region, the distance between the guide and the gripper being smaller than the width of the two halves of the folded printed products and the latter assuming a curved form between the conveying device and the guide.

9. An apparatus according to claim 8, further comprising a circulating clamping device having a strand which runs between the conveying device and the guide and having clamping parts configured to be moved towards and away from one another and move the two halves of the printed products towards one another in the region of the printing head, but above the border region which is to be printed typographically, and consequently increase the curvature of the two halves.

10. An apparatus according to claim 7 wherein the opening device comprises at least a first and second part which act on ends of the printed products remote from the fold of the two halves of said folded printed products and cause said ends to be displaced relative to one another and parallel to the conveying direction.

11. An apparatus according to claim 10, wherein the first and the second parts of the opening device are formed by respective grippers which each comprise a clamping tongue for securing the ends of the halves of the printed products, said grippers being arranged on respective circulating transporting devices which can be driven at different speeds in order to open the printed products.

12. An apparatus according to claim 11, wherein the printed products are conveyed in a fanned-out imbricated formation by the conveying device and are guided with respect to the opening device such that the first grippers, which move beneath the conveying device, at least substantially at the same speed thereas, retain the end remote from the fold of the half located in the rear, as seen in the conveying direction, of the folded printed products, while the second grippers which retain the end remote from the fold of the half located in the front of the folded printed products move at an increased speed with respect to the conveying device and bring about mutual displacement of the halves of the folded printed products, the printing head being arranged for the typographical labeling of the rear half of the printed products.

13. An apparatus according to claim 11, wherein the printed products conveyed in the fanned-out imbricated formation by the conveying device are guided with respect to the opening device such that the first grippers which move beneath the conveying device at an increased speed with respect to the same retain the end remote from the fold of the front half, as seen in the conveying direction, of the folded printed products, while the second grippers which retain the end remote from the fold of the rear half of the folded printed products, move at the same speed as the conveying device and consequently bring about the mutual displacement of the halves of the folded printed products, the printing head being arranged for the typographical printing of the leading, front half of the respective printed products.

14. An apparatus according to claim 13, wherein the opening device comprises a helical bar which is configured to be rotated about its longitudinal axis and whose longitudinal axis is arranged at least substantially parallel to the conveying direction, and said helical bar comprises windings which comprise a pitch corresponding at least essentially to the distance between the grippers of the conveying device, the bar serving to produce an initial opening of the two halves of the respective printed products, in that the opening device further comprises a guide rest whose rear section as seen in the conveying direction, is arranged within the helical bar and whose central section gradually comes closer to the conveying device and merges into a front section which is arranged parallel to, and beneath, the conveying device, the distance between the gripper of the conveying device and the front section of the guide rest being smaller than the width of the halves of the respective printed products, and the printing head is arranged in the region of a front end of the guide rest.

15. An apparatus according to claim 7, wherein the opening device comprises:

a guide unit arranged beneath the conveying device and having a rear section, as seen in the conveying direction, which is arranged at a distance, which is approximately the width of the folded printed products beneath the grippers of the conveying device, having a central section which gradually comes closer to the conveying device in the conveying direction, having a front section which runs beneath the conveying device, parallel thereto, and is spaced apart from said conveying device at a distance which is smaller than the width of the halves of the folded printed products, and having a conveying belt which is arranged in the front region of the static guide unit and can move at the speed of the conveying device;

pressure-exerting fingers, which are arranged on the grippers and, in the region between the central section of the static guide unit and the front section of the guide unit, assume a first position, in which their lower ends are at a vertical distance from the guide unit, and, by virtue of a pivoting movement, if appropriate together with a pivoting movement of the respective gripper, move out of said first position in the region of the front section of the guide unit into a second position, in which they press one half of the printed products on to the conveying belt; and a belt conveyor having a drive speed which is positioned beneath the conveying device having a conveying speed, said belt conveyor being positioned next to a front section of the guide unit, and which comprises two belts which are arranged to the left and right of the guide unit, the drive speed of the belt conveyor being greater than the conveying speed of the conveying device, with the result that, in order to open the product, the front halves, as seen in the conveying direction, of the printed product are moved away from the rear halves, which are pressed downwards by the fingers, the printing head being arranged in the region of the front end of the guide unit.

16. An apparatus according to claim 15, wherein friction between the printed products and the belt conveyor is greater than friction between the halves of the two products.

* * * * *